US006844852B1

(12) United States Patent
Simons

(10) Patent No.: US 6,844,852 B1
(45) Date of Patent: Jan. 18, 2005

(54) MICROELECTROMECHANICAL SYSTEMS ACTUATOR BASED RECONFIGURABLE PRINTED ANTENNA

(75) Inventor: Rainee N. Simons, North Olmsted, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 10/401,863

(22) Filed: Mar. 31, 2003

(51) Int. Cl.[7] ..... H01Q 1/38
(52) U.S. Cl. ..... 343/700 MS
(58) Field of Search ..... 343/700 MS, 876, 343/850, 702, 745, 846, 815, 816, 817, 818

(56) References Cited

U.S. PATENT DOCUMENTS 6,061,025 A * 5/2000 Jackson et al. ..... 343/700 MS
6,198,438 B1 * 3/2001 Herd et al. ..... 343/700 MS
6,501,427 B1 * 12/2002 Lilly et al. ..... 343/700 MS

OTHER PUBLICATIONS

Rainee N. Simons et al., "Microelectromechanical Systems (MEMS) Actuators for Antenna Reconfigurability," NASA/CR–2001–210612, Mar. 2001.

Rainee N. Simons et al., "Reconfigurable Array Antenna Using Micorelectromechanical Systems (MEMS) Actuators," NASA/CR–2001–210889, Apr. 2001.

Rainee N. Simons et al., "Polarization Reconfigurable Patch Antenna Using Microelectromechanical Systems (MEMS) Actuators," NASA/TM–2002–211353, Apr. 2002.

Rainee N. Simons, "Novel On–Wafer Radiation Pattern Measurement Technique for MEMS Actuator Based Reconfigurable Patch Antennas," NASA/TM–2002–211816, Oct. 2002.

* cited by examiner

*Primary Examiner*—Hoang V. Nguyen
(74) *Attorney, Agent, or Firm*—Squire, Sanders & Dempsey L.L.P.

(57) ABSTRACT

A polarization reconfigurable patch antenna is disclosed. The antenna includes a feed element, a patch antenna element electrically connected to the feed element, and at least one microelectromechanical systems (MEMS) actuator, with a partial connection to the patch antenna element along an edge of the patch antenna element. The polarization of the antenna can be switched between circular polarization and linear polarization through action of the at least one MEMS actuator.

19 Claims, 9 Drawing Sheets

MICROELECTROMECHANICAL SYSTEMS ACTUATOR BASED RECONFIGURABLE PRINTED ANTENNA

ORIGIN OF THE INVENTION

The invention described herein was made by an employee of the United States Government and may be manufactured and used by or for the Government for Government purposes without payment of any royalties thereon or therefore.

BACKGROUND OF THE INVENTION

1. Field of the Invention

The present invention relates to planar antennas, used in electromagnetic communication systems. In particular, the present invention is directed to planar, printed antennas that utilize microelectromechanical systems (MEMS) based switching and actuating devices or circuits.

2. Description of Related Art

Miniaturization of mechanical systems promises unique opportunities for new directions in the progress of science and technology. Micromechanical devices and systems are inherently smaller, lighter, faster, and usually more precise than their macroscopic counterparts. However, development of micromechanical systems requires appropriate fabrication technologies which enable: the definition of small geometries; precise dimensional control; design flexibility; interfacing with control electronics; repeatability, reliability, and high yield; and low-cost per device.

When these micromechanical devices, such as fluid sensors, mirrors, actuators, pressure and temperature sensors, vibration sensors and valves, can form microelectromechanical systems (MEMS). Typical MEMS devices combine sensing, processing and/or actuating functions to alter the way that the physical world is perceived and controlled. They typically combine two or more electrical, mechanical, biological, magnetic, optical or chemical properties on a single microchip.

In recent years MEMS based switching and actuating devices have emerged as a viable alternative to solid state control devices in microwave systems. The MEMS devices offer many advantages. These advantages include significant reduction in insertion loss, which results in higher figure-of-merit and the MEMS devices consume insignificant amount of power during operation, which results in higher efficiency. Also, the MEMS devices have higher linearity, hence lower signal distortion, when compared to semiconductor devices. In addition, it has been also demonstrated that MEMS based switches and actuators can enhance the performance of antennas.

Last, MEMS actuators have the potential to dynamically reconfigure the frequency, polarization, and radiation pattern of antennas thus providing total reconfigurability. The capability to dynamically reconfigure the radiation patterns of planar antennas through geometric reconfiguration is essential for undertaking diverse missions. These advantages have been the motivation to integrate MEMS switches/actuators with planar antennas for beam steering and frequency/polarization reconfiguration.

For example, a patch antenna on a suspended micromachined fused quartz substrate that can rotate can perform spatial scanning of the beam, as discussed in D. Chauvel, N. Haese, P.-A. Rolland, D. Collard, and H. Fujita, "A Micro-Machined Microwave Antenna Integrated with its Electrostatic Spatial Scanning," Proc. IEEE Tenth Annual Inter. Workshop on Micro Electro Mechanical Systems (MEMS 97), pp. 84–89, Nagoya, Japan, Jan. 26–30, 1997. A Vee-antenna with moveable arms constructed from polysilicon material can steer as well as shape the beam, as discussed in J.-C. Chiao, V. Fu, I. M. Chio, M. DeLisio and L.-Y. Lin, "MEMS Reconfigurable Vee Antenna," 1999 IEEE MU-S Inter. Microwave Symp. Dig., Vol. 4, pp. 1515–1518, Anaheim, Calif., Jun. 13–19, 1999. Furthermore, a field programmable metal array consisting of several thousand microswitches placed along the perimeter of a patch antenna can provide frequency reconfigurability, as discussed in S. M. Duffy, "MEMS Microswitch Arrays for Reconfigurable Antennas," Notes of the Workshop "RF MEMS for Antenna Applications," 2000 IEEE Ant. & Prop. Inter. Symp., Salt Lake City, Utah, Jul. 16, 2000.

Even taking these examples into account, the prior art has not demonstrated a polarization reconfigurable patch antenna made by use of integrated MEMS actuator. Thus, there is a need for a nearly square patch that can dynamically reconfigure the polarization from circular to linear, thus providing polarization diversity. There is also a need for a MEMS actuator that is housed within the patch and does not require additional space. This feature is particularly important in the construction of a N by N planar array antenna with small inter-element spacing.

SUMMARY OF THE INVENTION

The present invention is directed to a polarization reconfigurable patch antenna. One of the key features of this invention are that the printed antennas with Integrated MEMS operate over several frequency bands without changing dimensions. Additionally, the polarization of the printed antenna can be switched from circular to linear or vice-versa.

According to one aspect of this invention, an antenna is disclosed having a feed element, a patch antenna element electrically connected to the feed element, and at least one microelectromechanical systems (MEMS) actuator, with a partial connection to the patch antenna element along an edge of the patch antenna element. The polarization of the antenna can be switched between circular polarization and linear polarization through action of the at least one MEMS actuator.

Additionally, the patch antenna element may have a length and a width that are approximately equal. Also, the antenna may be configured to transmit and receive signals over multiple frequency bands. Additionally, the at least one MEMS actuator may be at least two MEMS actuators having partial connections to the patch antenna along orthogonal edges of the patch antenna element. Also, the polarization of the antenna may be switched by setting at least one of the at least two MEMS actuators to an ON-state or an OFF-state. Also, the transmission and receipt of signals over one frequency band to another frequency band of the antenna is switched by setting at least one of the at least two MEMS actuators to an ON-state or an OFF-state.

According to another embodiment, a antenna has signal means for providing and receiving a signal from the antenna, patch antenna means for transmitting and receiving electromagnetic radiation, electrically connected to the signal means and microelectromechanical systems (MEMS) actuating means for moving a metal overpass, with the MEMS actuating means in partial connection to the patch antenna means along an edge of the patch antenna means. A polarization of the antenna can be switched between circular polarization and linear polarization through action of the MEMS actuating means.

In an alternate embodiment, a method for switching a polarization of an antenna is disclosed. The antenna has a feed element, a patch antenna element electrically connected to the feed element and at least two microelectromechanical systems (MEMS) actuators, with partial connections to the patch antenna element along orthogonal edges of the patch antenna element. The method comprises the step of setting at least one of the at least two MEMS actuators to an ON-state or an OFF-state. Additionally, the at least two MEMS actuators may be two MEMS actuators and the setting step is then setting both of the two MEMS actuators to the ON-state or the OFF-state.

These and other objects of the present invention will be described in or be apparent from the following description of the preferred embodiments.

BRIEF DESCRIPTION OF THE DRAWINGS

For the present invention to be easily understood and readily practiced, preferred embodiments will now be described, for purposes of illustration and not limitation, in conjunction with the following figures.

DETAILED DESCRIPTION OF PREFERRED EMBODIMENTS

The present invention is directed to a novel reconfigurable printed antenna using RF microelectromechanical systems (MEMS) actuator. One of the key features of this invention are that the printed antennas with Integrated MEMS operate over several frequency bands without changing dimensions. Additionally, the polarization of the printed antenna can be switched from circular to linear or vice-versa.

The efficacy of this invention is demonstrated through experiments conducted on two rectangular patch antennas and a nearly square patch antenna with integrated RF MEMS actuator. Experimental results demonstrate that the center frequency of the rectangular patch antenna can be reconfigured from few hundred MHz to few GHz away from the nominal operating frequency and the polarization of the nearly square patch can be dynamically reconfigured from circular to linear.

Figure 1:
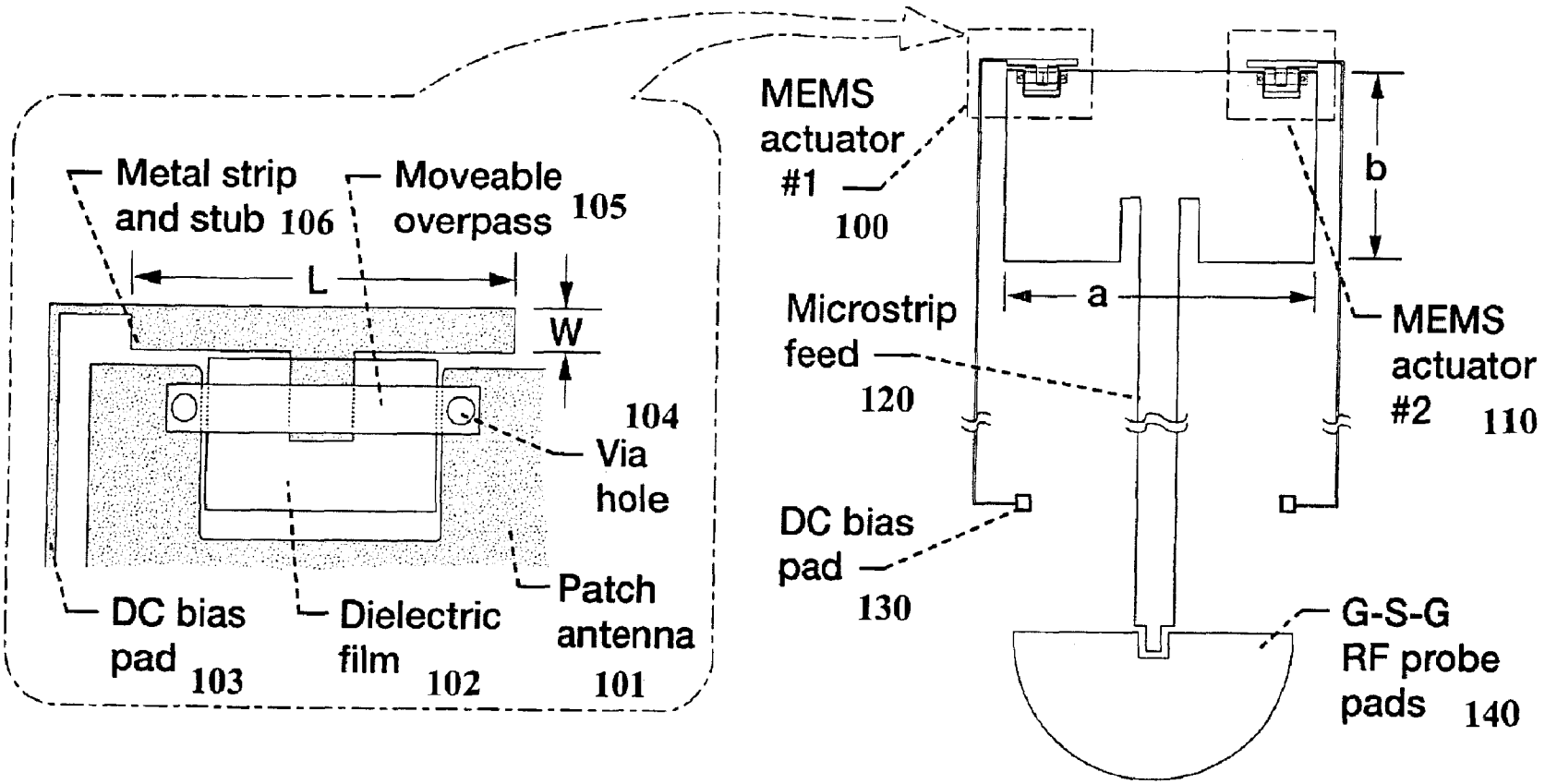
FIG. 1 illustrates a frequency reconfigurable patch antenna element with two independent MEMS actuators, according to one embodiment of the present invention.
Figure 2:
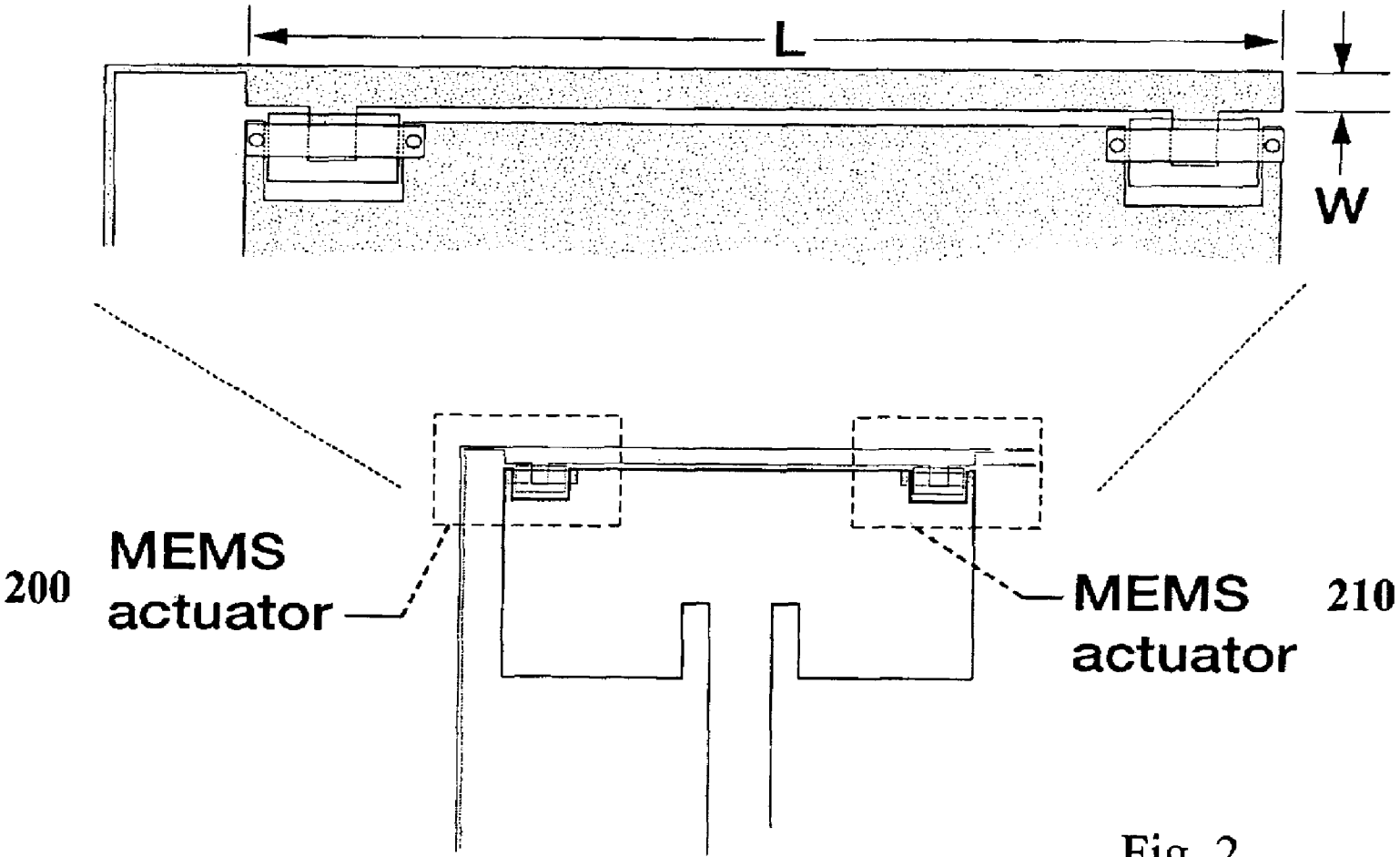
FIG. 2 illustrates a frequency reconfigurable patch antenna element with two series MEMS actuators, according to one embodiment of the present invention.

Rectangular patch antennas with two independent MEMS actuators and with two MEMS actuators in series are illustrated in FIGS. 1 and 2, respectively. FIG. 1 illustrates the antenna with two MEMS actuators #1 and #2, 100 & 10. The antenna also has a microstrip feed 120 and each actuators has a DC bias pad 130. As illustrated, ground-signal-ground (G-S-G) RF probe pads 140 are shown attached and are used for testing. Each actuator consists of a moveable metal overpass 105 suspended over a metal stub 106, connected to a section of the DC bias pad 103. The overpass is supported at either ends by metalized vias 104 which are electrically connected to the patch antenna 101. The MEMS actuators 200 & 210 illustrated in FIG. 2 are similar to those illustrated in FIG. 1, except that the metal stubs are connected.

Figure 3:
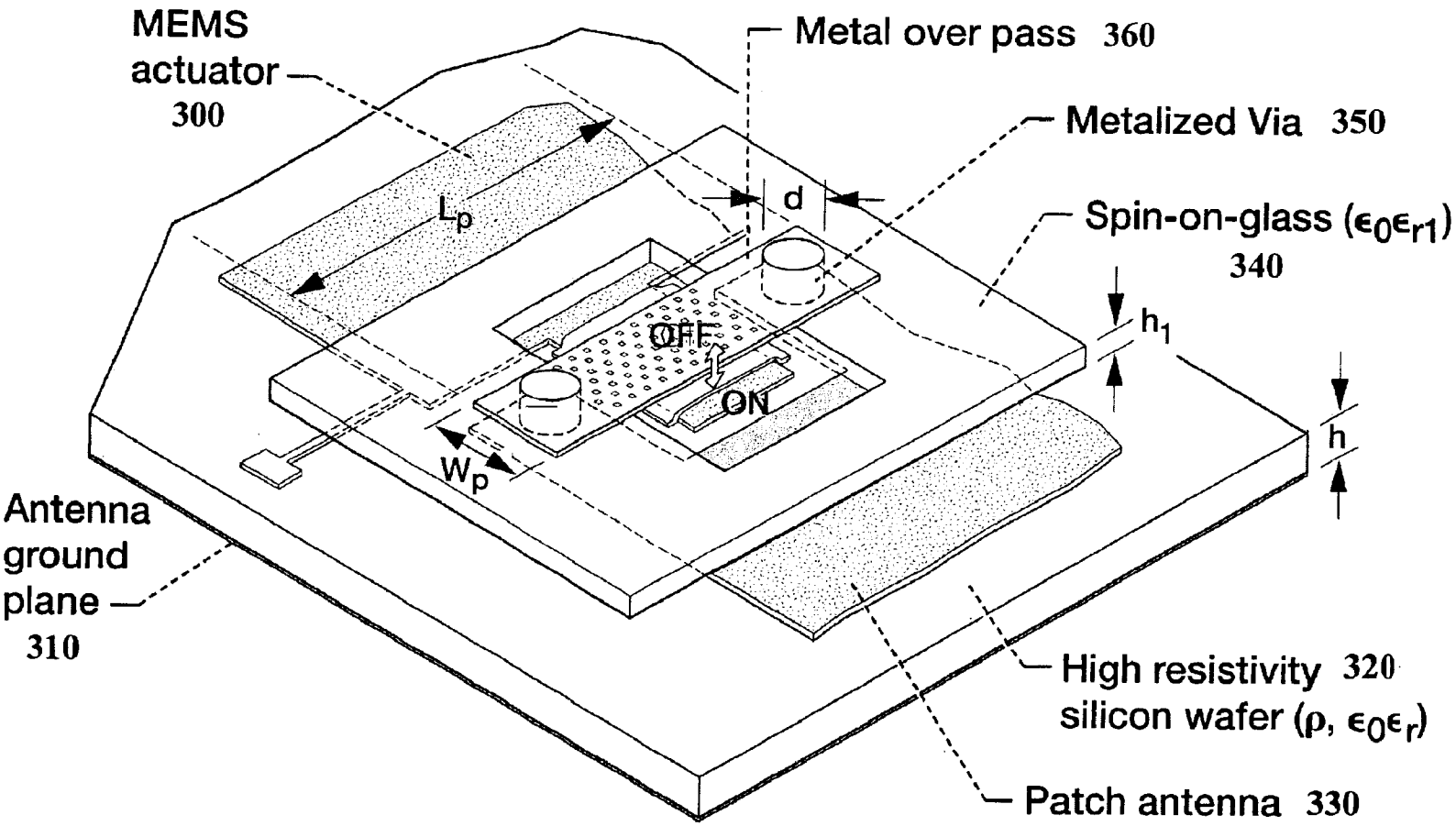
FIG. 3 illustrates a schematic of a MEMS actuator integrated with a patch antenna element, according to one embodiment of the present invention.

The metal overpass 306, illustrated in the MEMS actuator 300 in FIG. 3, is free to move up and down and is actuated by an electrostatic force of attraction set up by a voltage applied between the overpass and the metal stub as illustrated in FIG. 3. The overpass is supported at either ends by metalized vias 350 which are electrically connected to the patch antenna 330. A dielectric film 340 deposited over the metal stub prevents stiction when the surfaces come in contact. In the embodiment illustrated in FIG. 3, the support surface is a high resistivity silicon wafer 320, with the antenna ground plane 310 applied to the opposite side of the wafer.

The metal strip of length L and width W attached to the metal stub behaves as a parallel plate capacitor. The patch antenna operates at its nominal frequency as determined by the dimension b when the actuator is in the OFF state. The actuator is in the ON state when the overpass is pulled down by the electrostatic force due to the bias, and the capacitance of the metal strip appears in shunt with the input impedance of the patch antenna. This capacitance tunes the patch to a lower operating frequency. During the synthesis process, the inductance and capacitance of the actuators and their locations in the patch are taken into account in order to ensure a constant input impedance.

Figure 4:
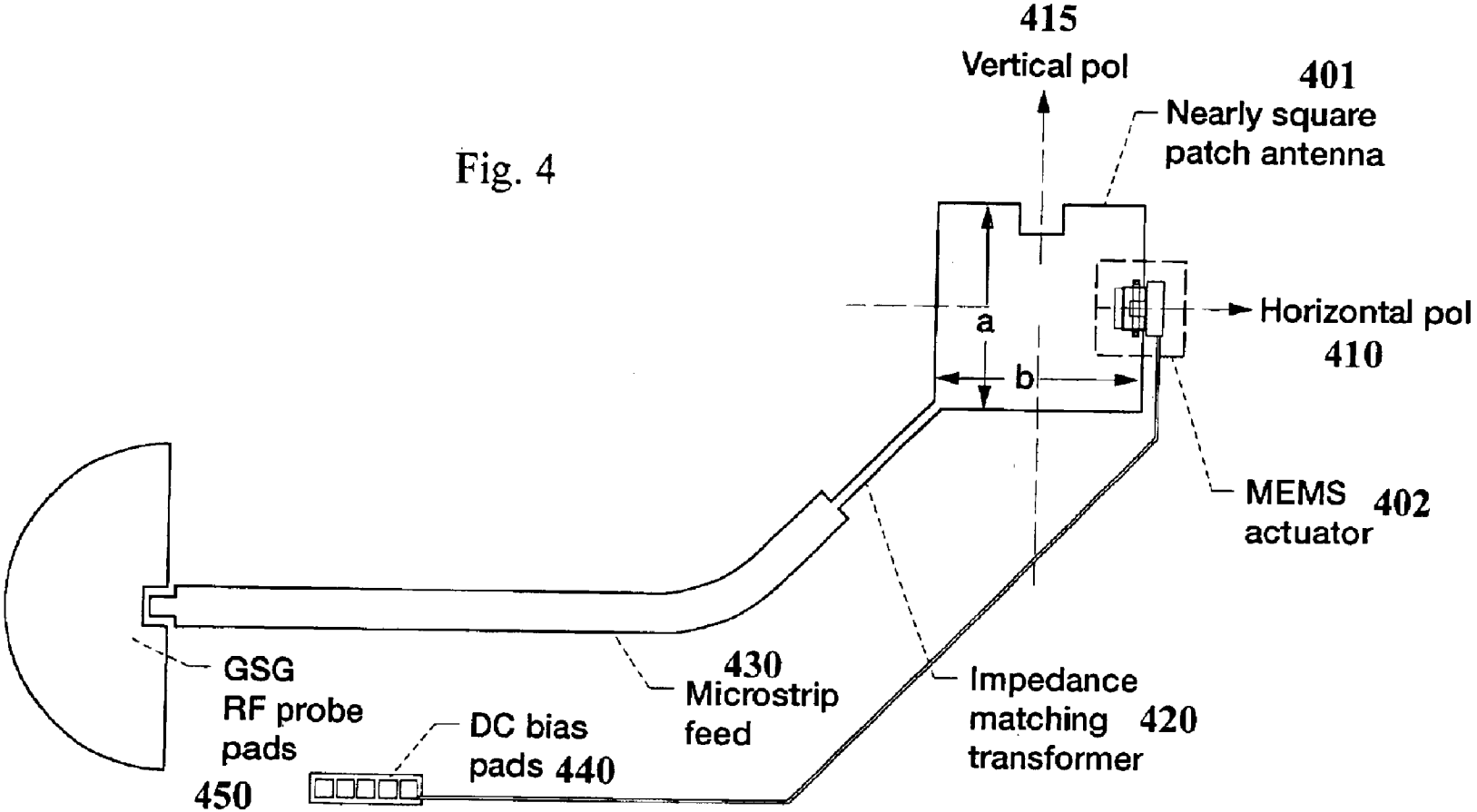
FIG. 4 illustrates a polarization reconfigurable patch antenna element with integrated MEMS actuator, according to one embodiment of the present invention.

A nearly square patch antenna 401 with notches illustrated in FIG. 4, is designed to support two degenerate orthogonal modes when excited at a corner. The horizontal 410 and vertical 415 polarization directions are illustrated. Such excitation at the corner occurs through the impedance matching transformer 420 to a micro strip feed 430. The G-S-G RF probe pads 450 and the DC bias pads 440 are also illustrated in FIG. 4. When the MEMS actuator is in the OFF-state the perturbation of the modes is negligible and hence the patch radiates a circularly polarized (CP) wave. When an electrostatic force resulting from the application of a bias pulls down the overpass, the MEMS actuator is in the ON-state. This action perturbs the phase relation between the two modes causing the patch to radiate dual linearly polarized (LP) waves.

The patch antennas with the integrated MEMS actuators are experimentally characterized by measuring the return loss, $S_{11}$, as a function of the frequency with and without the actuation voltage. The return loss is measured using a ground-signal-ground RF probe calibrated to the tips using an impedance standard substrate. The actuation voltage is 55 V.

Figure 5A:
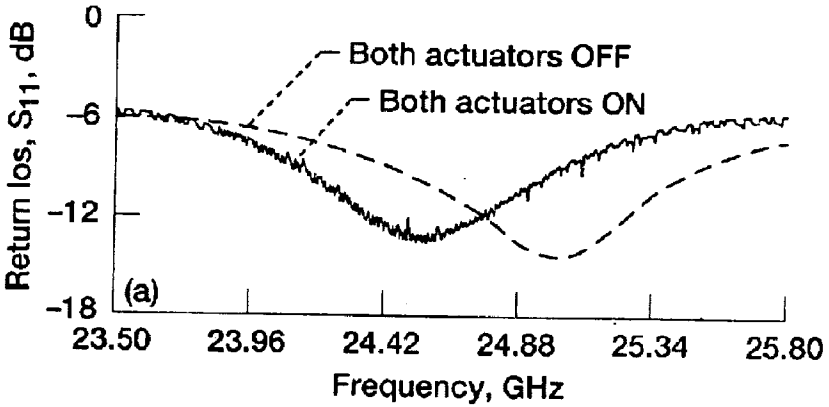
FIGS. 5(*a*), (*b*) and (*c*) depict graphs showing the measured return loss illustrating frequency reconfigurability when the MEMS actuators are biased independently, according to one embodiment of the present invention.
Figure 5B:
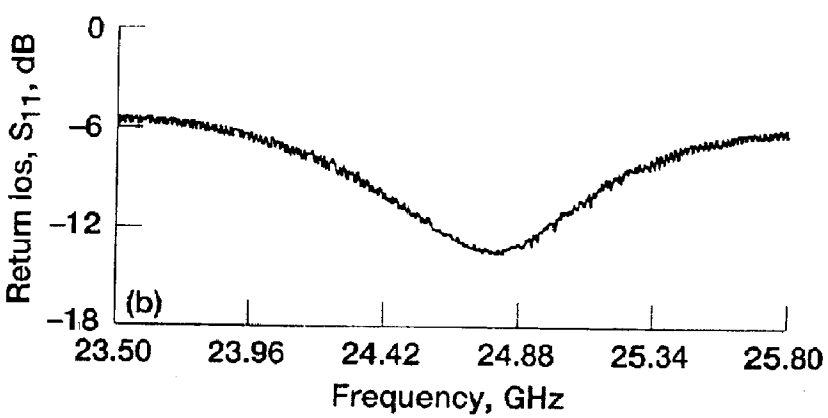
Figure 5C:
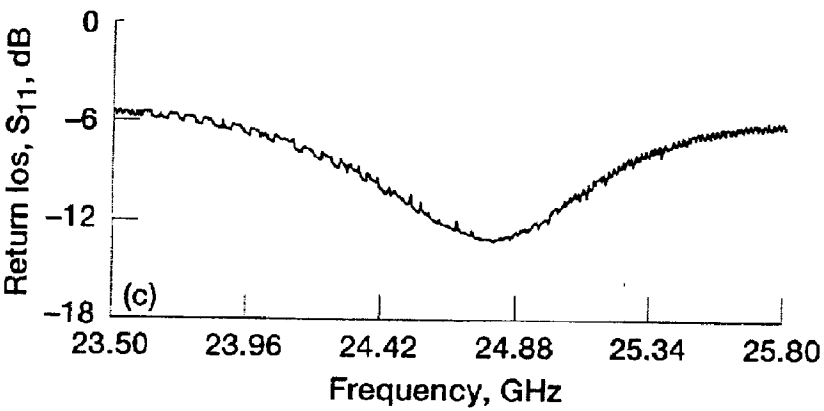

The experimental results for a rectangular patch with two independent actuators are now discussed. The measured return loss for the two states of the actuators are shown in FIGS. 5(*a*) through (*c*). When both the actuators are in the OFF state, the patch resonates at its nominal operating frequency of about 25.0 GHz as shown in FIG. 5(*a*). The −10.0 dB return loss bandwidth of the patch is about 3.3 percent.

When actuator #1 is in ON state and actuator #2 is in the OFF state, the resonant frequency shifts to about 24.8 GHz as shown in FIG. 5(*b*). Similarly, when actuator # 1 is in the OFF state and actuator #2 is in the ON state, the resonant frequency shifts to 24.8 GHz. This result is expected since the two actuators are identical in construction. The step change of 200 MHz in the resonant frequency for both cases is about 0.8 percent of the patch nominal operating frequency.

Finally, when both actuators are in the ON state, the resonant frequency is 24.6 GHz as shown in FIG. 5(*a*). The shift is twice as much as the case, when a single actuator is turned ON. Furthermore at resonance, the magnitudes of the return loss are almost equal for the two states, implying minimum loss of sensitivity. Thus, for this configuration, the patch antenna can be dynamically reconfigured to operate at different bands separated by a few hundred MHz, by digitally addressing either actuators or both actuators. This is a desirable feature in mobile wireless systems to enhance capacity as well as combat multipath fading.

Figure 6:
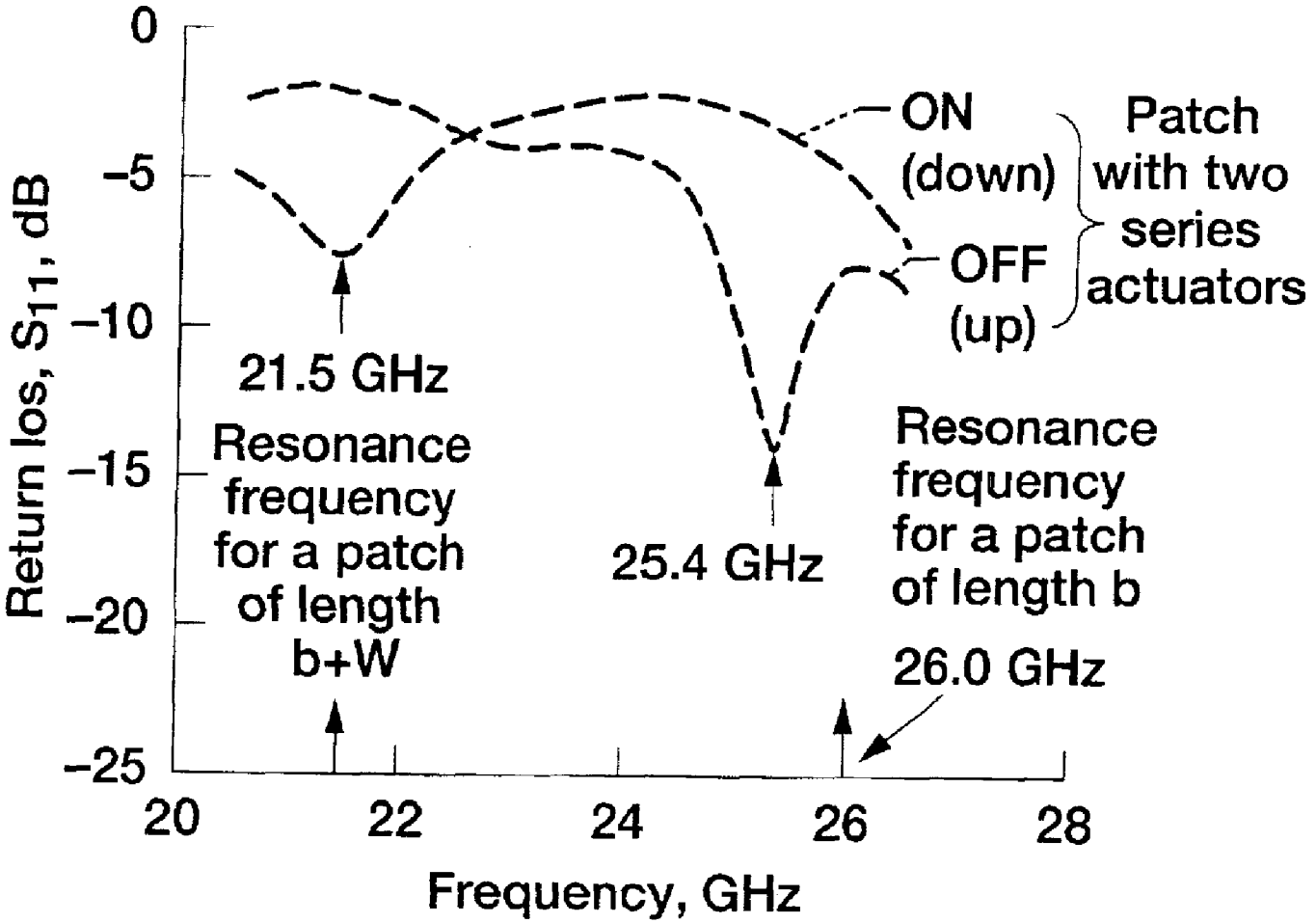
FIG. 6 depicts the measured return loss based on frequency when the two series MEMS actuators are either in the OFF state or ON state, according to one embodiment of the present invention.

The experimental results for a rectangular patch with two series actuators are now discussed. The measured return loss of the patch antenna with the MEMS actuator in the ON and OFF states are shown in FIG. 6. It is observed that when the actuator is in the OFF state the patch resonates at about 25.4 GHz. When the actuator is in the ON state, the resonant frequency shifts to 21.5 GHz. It is noted that for this experimental result that the impedance matching at 21.5 GHz was not optimized. The numerically simulated resonant frequency is about 21.6 GHz. Thus, for this configuration, the patch antenna can be dynamically reconfigured to operate at two different bands separated by a few GHz, such as, for transmit and receive functions in satellite communications.

Figure 7:
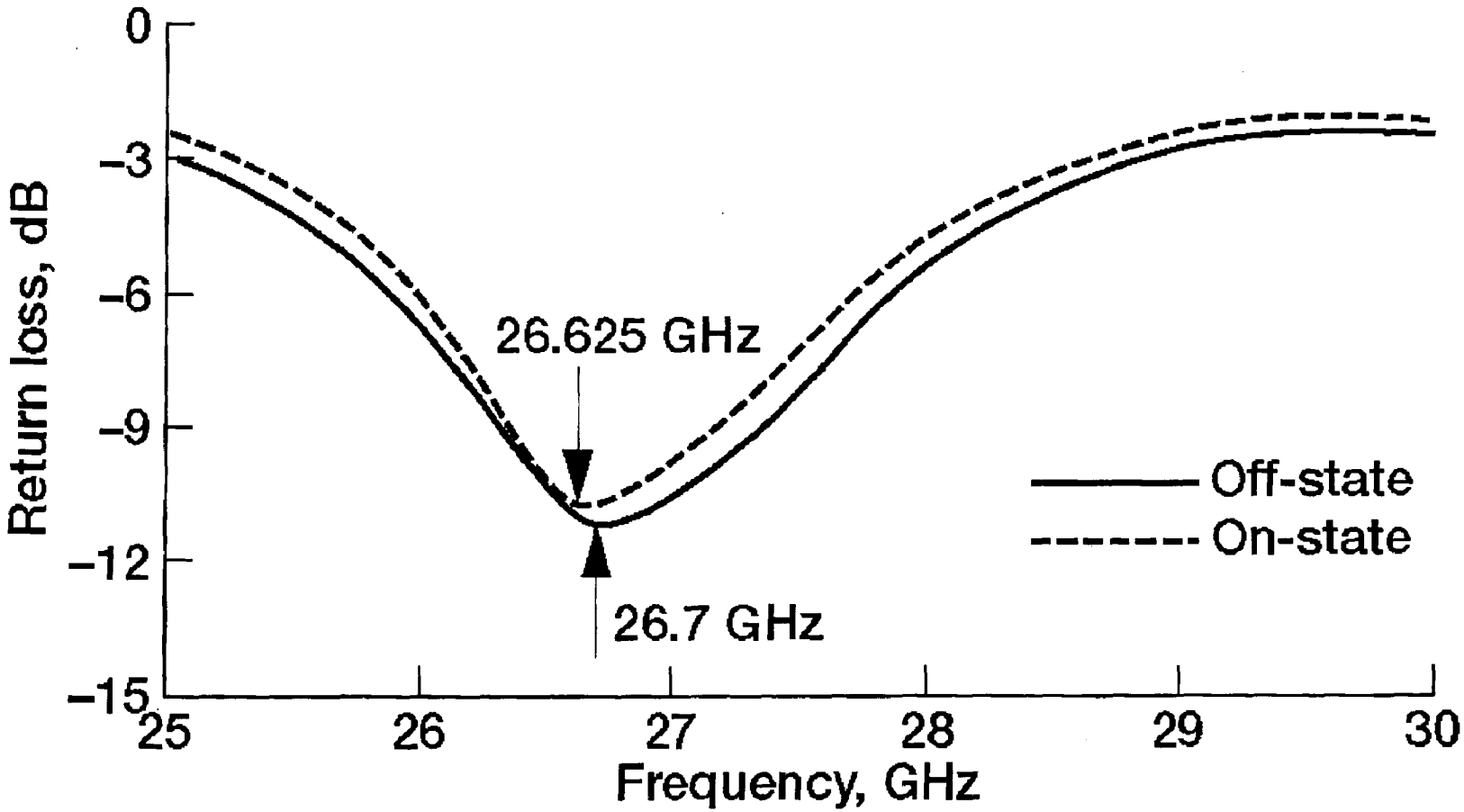
FIG. 7 illustrates the measured return loss as a function of frequency, according to one embodiment of the present invention.
Figure 8:
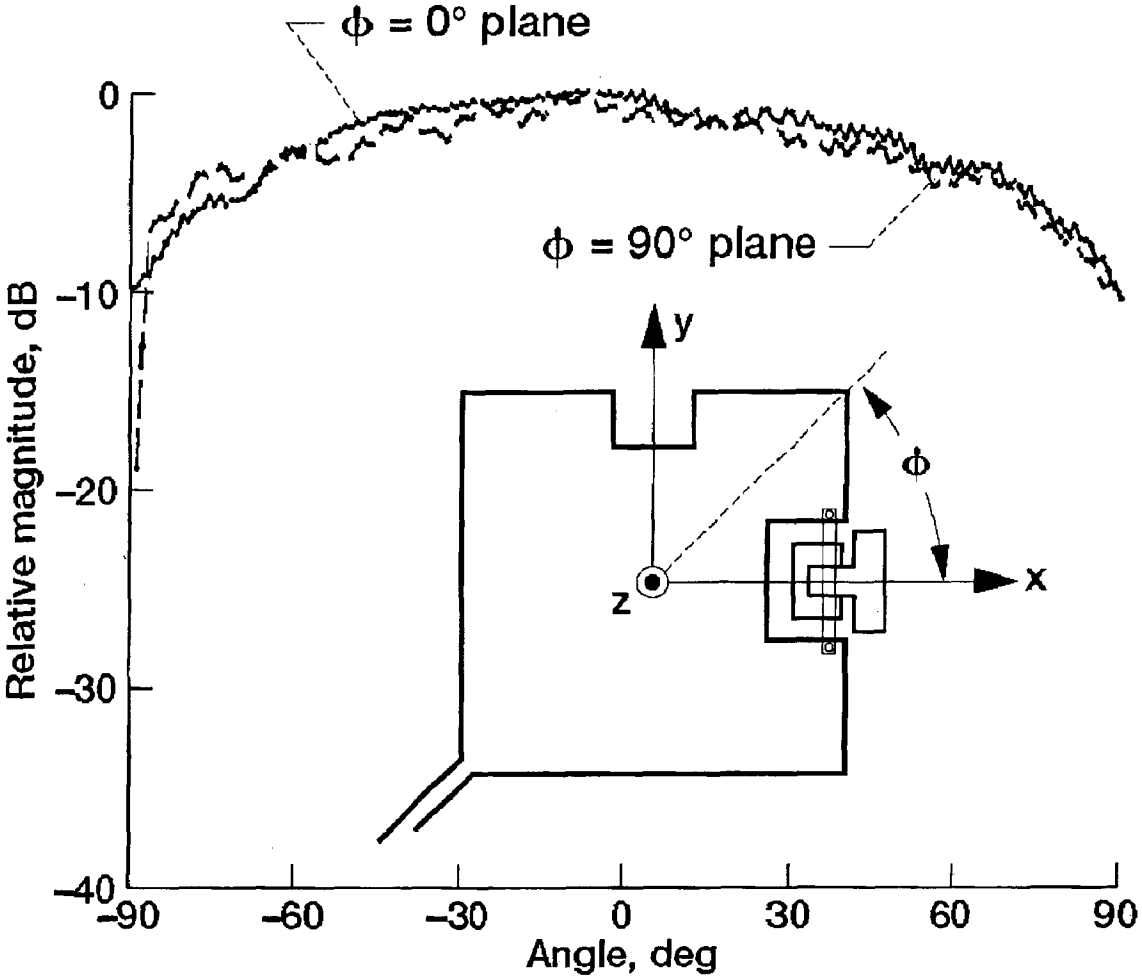
FIG. 8 depicts the measured circularly polarized radiation patterns as a function of angle, according to one embodiment of the present invention.
Figure 9:
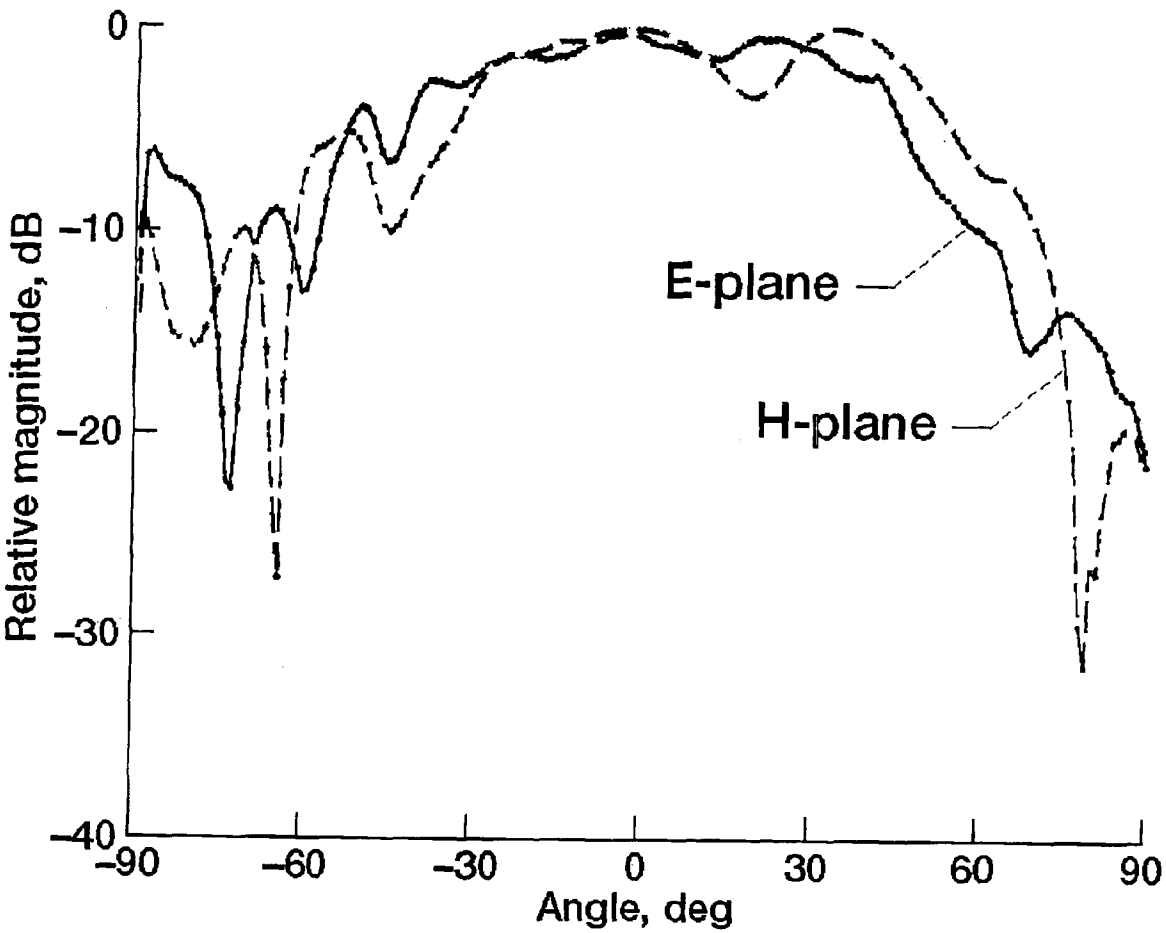
FIG. 9 depicts the measured linearly polarized radiation patterns for vertical polarization as a function of angle, according to one embodiment of the present invention.

The experimental results for a nearly square patch antenna with actuator are now discussed. The measured return loss for the OFF-state and the ON-state of the actuator are shown in FIG. 7. The measured resonant frequencies in the OFF-state and the ON-state are 26.7 GHz and 26,625 GHz, respectively. In both states the patch is well matched to the 50 Ohm feed line. The change in the resonant frequency for the two states is considered to be small. The measured circularly polarized (CP) radiation patterns along the two orthogonal planes when the MEMS actuator is in the OFF-state are shown in FIG. 8. The measured axial ratio at boresight is about 2.0 dB. In the ON-state, the patch radiates dual linearly polarized waves. The measured E- and H-plane radiation patterns for the vertical polarization are shown in FIG. 9. Similar radiation patterns are observed for the horizontal polarization.

The MEMS actuators and the antennas utilizing the same, as disclosed herein, have many benefits, based on the structures and experimental results of the various embodiments discussed above. The embodiments have the benefit, as compared to the prior art devices, of being reliable, compact and electronically controlled. Their multiple functionalities allow for elimination of redundancies in that the same antenna can be used for multiple purposes; i.e. the same antenna providing functioning over different frequencies and/or polarizations. The discussed embodiments are also useful in that they do not require a semiconductor device. Thus, they are linear, providing a higher data rate and additionally are radiation hard, which can be useful in a variety of situations in which the antenna structures are used.

Although the invention has been described based upon these preferred embodiments, it would be apparent to those of skilled in the art that certain modifications, variations, and alternative constructions would be apparent, while remaining within the spirit and scope of the invention. In order to determine the metes and bounds of the invention, therefore, reference should be made to the appended claims.

What is claimed is:

1. An antenna comprising:

a feed element;

a patch antenna element electrically connected to the feed element; and at least one microelectromechanical systems (MEMS) actuator, with a partial connection to the patch antenna element along an edge of the patch antenna element;

wherein a polarization of the antenna can be switched between circular polarization and linear polarization through action of the at least one MEMS actuator.

2. An antenna as recited in claim 1, wherein a length and a width of said patch antenna are approximately equal.

3. An antenna as recited in claim 1, wherein said antenna is configured to transmit and receive signals over multiple frequency bands.

4. An antenna as recited in claim 1, wherein said at least one MEMS actuator comprises at least two MEMS actuators having partial connections to the patch antenna along orthogonal edges of the patch antenna element.

5. An antenna as recited in claim 4, wherein said polarization of the antenna is switched by setting at least one of said at least two MEMS actuators to an ON-state or an OFF-state.

6. An antenna as recited in claim 4, wherein said antenna is configured to transmit and receive signals over multiple frequency bands.

7. An antenna as recited in claim 6, wherein the transmission and receipt of signals over one frequency band to another frequency band of the antenna is switched by setting at least one of said at least two MEMS actuators to an ON-state or an OFF-state.

8. An antenna comprising:

signal means for providing and receiving a signal from the antenna;

patch antenna means for transmitting and receiving electromagnetic radiation, electrically connected to the signal means; and microelectromechanical systems (MEMS) actuating means for moving a metal overpass, with the MEMS actuating means in partial connection to the patch antenna means along an edge of the patch antenna means;

wherein a polarization of the antenna can be switched between circular polarization and linear polarization through action of the MEMS actuating means.

9. An antenna as recited in claim 8, wherein a length and a width of said patch antenna means are approximately equal.

10. An antenna as recited in claim 8, wherein said antenna is configured to transmit and receive signals over multiple frequency bands.

11. An antenna as recited in claim 8, wherein said MEMS actuating means comprises at least two MEMS actuators having partial connections to the patch antenna means along orthogonal edges of the patch antenna means.

12. An antenna as recited in claim 11, wherein said polarization of the antenna is switched by setting at least one of said at least two MEMS actuators to an ON-state or an OFF-state.

13. An antenna as recited in claim 11, wherein said antenna is configured to transmit and receive signals over multiple frequency bands.

14. An antenna as recited in claim 13, wherein the transmission and receipt of signals over one frequency band to another frequency band of the antenna is switched by setting at least one of said at least two MEMS actuators to an ON-state or an OFF-state.

15. A method for switching a polarization of an antenna, the antenna comprising:

a feed element;

a patch antenna element electrically connected to the feed element; and at least two microelectromechanical systems (MEMS) actuators, with partial connections to the patch antenna element along orthogonal edges of the patch antenna element;

and the method comprising the step of:

setting at least one of said at least two MEMS actuators to an ON-state or an OFF-state.

16. An antenna as recited in claim 15, wherein said at least two MEMS actuators comprises two MEMS actuators and the setting step comprises setting both of the two MEMS actuators to the ON-state.

17. An antenna as recited in claim 15, wherein said at least two MEMS actuators comprises two MEMS actuators and the setting step comprises setting both of the two MEMS actuators to the OFF-state.

18. An antenna as recited in claim 15, wherein said antenna is configured to transmit and receive signals over multiple frequency bands.

19. An antenna as recited in claim 18, wherein the transmission and receipt of signals over one frequency band to another frequency band of the antenna is switched by setting at least one of said at least two MEMS actuators to an ON-state or an OFF-state.

* * * * *